US005533137A

United States Patent [19]

Holmes

[11] Patent Number: 5,533,137

[45] Date of Patent: Jul. 2, 1996

[54] EARPHONES

[75] Inventor: Richard Holmes, Nuneaton, United Kingdom

[73] Assignee: Virtuality IP Limited, Leicester, United Kingdom

[21] Appl. No.: 258,062

[22] Filed: Jun. 10, 1994

[30] Foreign Application Priority Data

Jun. 16, 1993 [GB] United Kingdom ..... 9312381

[51] Int. Cl.[6] ..... H04R 25/00

[52] U.S. Cl. ..... 381/183; 381/187; 381/25

[58] Field of Search ..... 381/169, 183, 381/187, 25; 345/7, 8; 379/430; 181/129, 137

[56] References Cited

U.S. PATENT DOCUMENTS 4,875,233 10/1989 Derhaag et al. ..... 381/169
4,882,769 11/1989 Gallimore ..... 455/344
5,003,300 3/1991 Wells ..... 340/705

FOREIGN PATENT DOCUMENTS 1183487 3/1970 United Kingdom .
1363723 8/1974 United Kingdom .
2254513 10/1992 United Kingdom .

*Primary Examiner*—Curtis Kuntz
*Assistant Examiner*—Sinh Tran
*Attorney, Agent, or Firm*—Young & Thompson

[57] ABSTRACT

In a head mounted display (1) an annular body (2) worn generally horizontally about the head of wearer supports a forwardly disposed optical display device (3) adapted to seat on the bridge of the nose of a user. At either side of the body (2) projections (10,11) extend toward respective ear positions. At the free end of the projection (10) earphone means (14) are provided to rotate eccentrically about a thumbscrew 20 at least between a plurality of angular positions. Thus, an ear-pad (15) can move between the position illustrated and positions such as C, D and E shown by chain dotted lines, thereby permitting the position of the earphone means 14 to be altered to accomodate different ear positions of the user.

5 Claims, 3 Drawing Sheets

EARPHONES

BACKGROUND OF THE INVENTION

1. Field of the Invention

This invention relates to the disposition of earphones on head mounted visors or display apparatus generally. More particularly, but not exclusively, it relates to such disposition on a head mounted display (HMD) adapted for use in virtual reality applications.

2. Description of the Prior Art

Originally virtual reality applications involved the user being surrounded by a projected image or a plurality of video monitors. Stereoscopic sound effects could be provided readily by conventional hi-fi speaker systems. Latterly, head mounted displays have become the norm in which the virtual image is displayed by means of a pair of small video screens viewed through binocular optical devices. These HMD's have been extremely bulky and are generally in the form of a helmet lowered on to the head of a user. Such helmets generally have sufficient internal space to mount small speaker drivers positioned to be adjacent and spaced apart from the ears of a user.

Large HMD's of helmet form have various disadvantages associated with their bulk and weight. In particular the virtual illusion is to some degree detracted from as a consequence of wearing an HMD because the wearers head appears to have a greater weight and moment of inertia than it would have in real situations. Consequently, it has long been desired to provide a lightweight HMD more akin to a visor comprising an adjustable head band fitting closely about the head of a user. Recent advances in miniature video screen and optics technology have made this a feasible proposition. However, proposed lightweight HMD's lack the internal space of the prior helmet type designs. Consequently, they provide no room to mount small speaker drivers.

To overcome the space limitations of lightweight HMD's it has been suggested that small earphones, commonly used with WALKMAN (™) type cassette players, could be mounted on the inner side faces of the head band. However, clear sound reception from small earphones requires that they are accurately aligned with the ear canals of a user. Hence because a head band must be adjustable to fit different head sizes a generally central disposition of the earphones suggests itself.

Unfortunately, anthropomorphic models of different human head sizes illustrate that the relative dimensions of the human head are not constant from one subject to another. In particular, the position of the ear canals relative to the bridge of the nose and rear of the skull will vary from person to person. Consequently, there can be no optimum position on an adjustable head band at which to place small earphones. To overcome this the obvious solution is use miniature headphones separate from the HMD which may be positioned independently thereof.

OBJECT OF THE INVENTION

It is an object of the invention to provide lightweight head mounted apparatus comprising an earphone the position of which is adjustable to suit different users.

SUMMARY OF THE INVENTION

According to the invention, there is provided a head-mounted apparatus comprising a member adapted, when worn, to locate about the wearer's head in a generally horizontal plane and an earphone means mounted to one side of said member to be relatively rotatable about an axis eccentric of the earphone means, lying generally parallel to said plane and transverse of said member whereby the position of the earphone means is adjustable relative to the member to accommodate different ear positions.

Preferably, the member supports a forwardly disposed optical display device and is in the form of an annular head band adjustable to fit snuggly about the head of the wearer. Typically, the earphone is rigidly and concentrically mounted to a housing from an inward face of which can extend a foam ear-pad with the outward face being eccentrically mounted to said member.

The member may further comprise at one side thereof a rearwardly and downwardly extending projection. This projection may be integral with a rigid end piece of a cable harness extending rearwardly thereof.

Suitably, a mounting bracket extends radially of the outward face of the housing and a stud extends outwardly of and adjacent the free end of said bracket into a throughbore in said projection where it is rotatably received, with the arrangement providing that the axis of said stud is the eccentric axis about which the earphone means is rotatable. The stud may comprise a threaded axial blind bore extending from the free end thereof with the stud being held captive in said throughbore of the projection by means of a threaded thumbscrew operable to clamp said mounting bracket to said projection.

BRIEF DESCRIPTION OF THE DRAWINGS

In addition, the apparatus may further comprise complementary interengaging detent formations associated respectively with said projection and said mounting bracket permit the position of the earphone means to be set at one of a predetermined plurality of angular adjustment positions.

An embodiment of the invention will now be described by way of non-limiting example only and with reference to the accompanying drawings, in which.

DESCRIPTION OF THE PREFERRED EMBODIMENT

A head mounted display apparatus 1 for use in virtual reality games applications is a preferred embodiment of the invention. As shown in FIG, 1 it comprises a member 2 in the form of an annular band which can be fitted about the head of a wearer. The member 2 supports a forwardly mounted optical display device 3 and has rear adjustment means 4.

Figure 2:
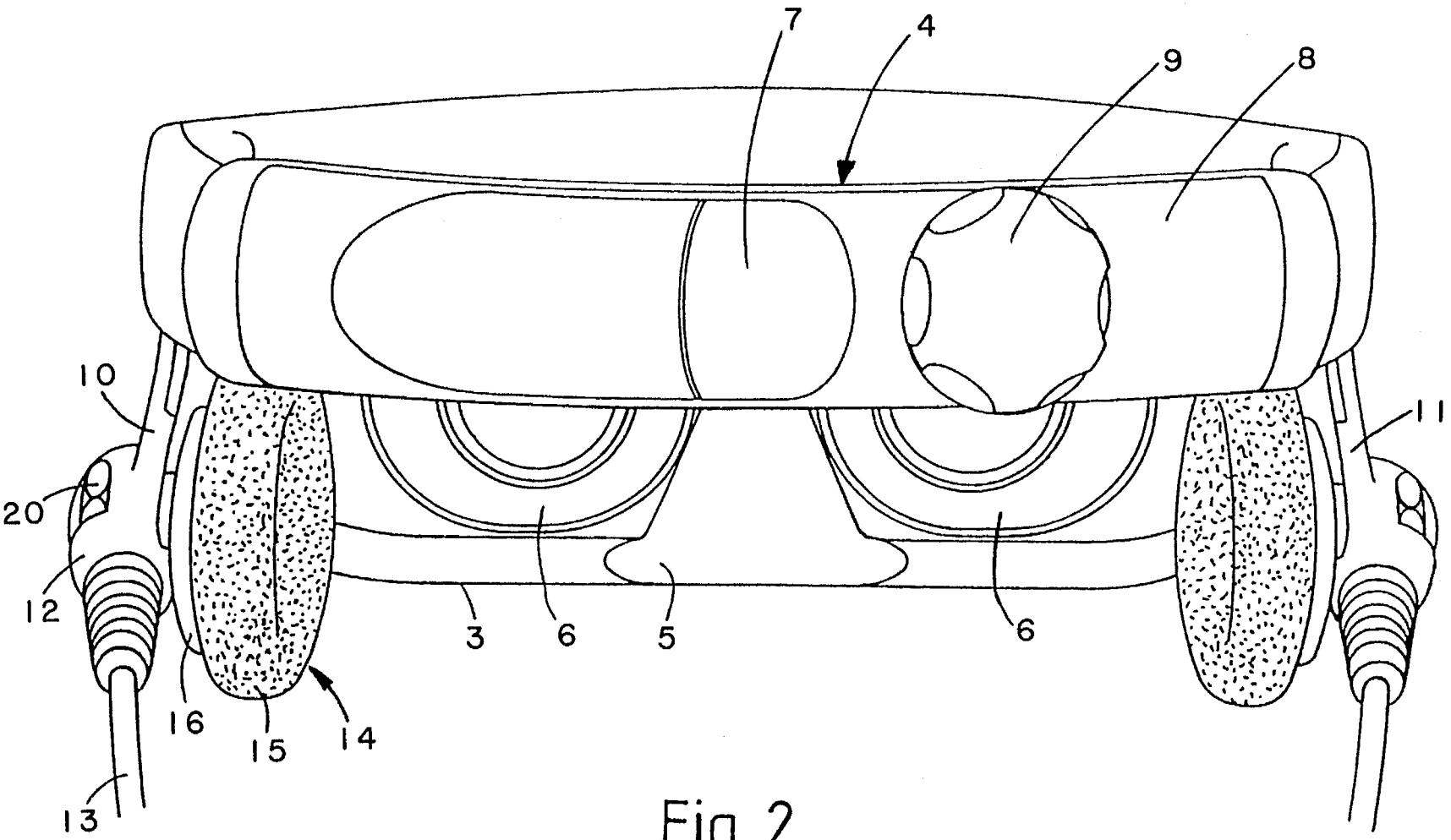
FIG. 2 is a rear view of the apparatus shown in FIG. 1.

Illustrated in FIG. 2, the optical display device 3 has a central section 5 adapted to sit on the bridge of the nose of a wearer either side of which are disposed binocular viewing ports 6. Forwardly of each port 6 is disposed a respective lens means and miniature video screen (not shown). The adjustment means 4 can be seen to comprise a strap 7 movable in a buckle 8 in which it is clampable by locking device 9. Relative movement of strap 7 and buckle 8 alters the size of the annular band 2.

Figure 1:
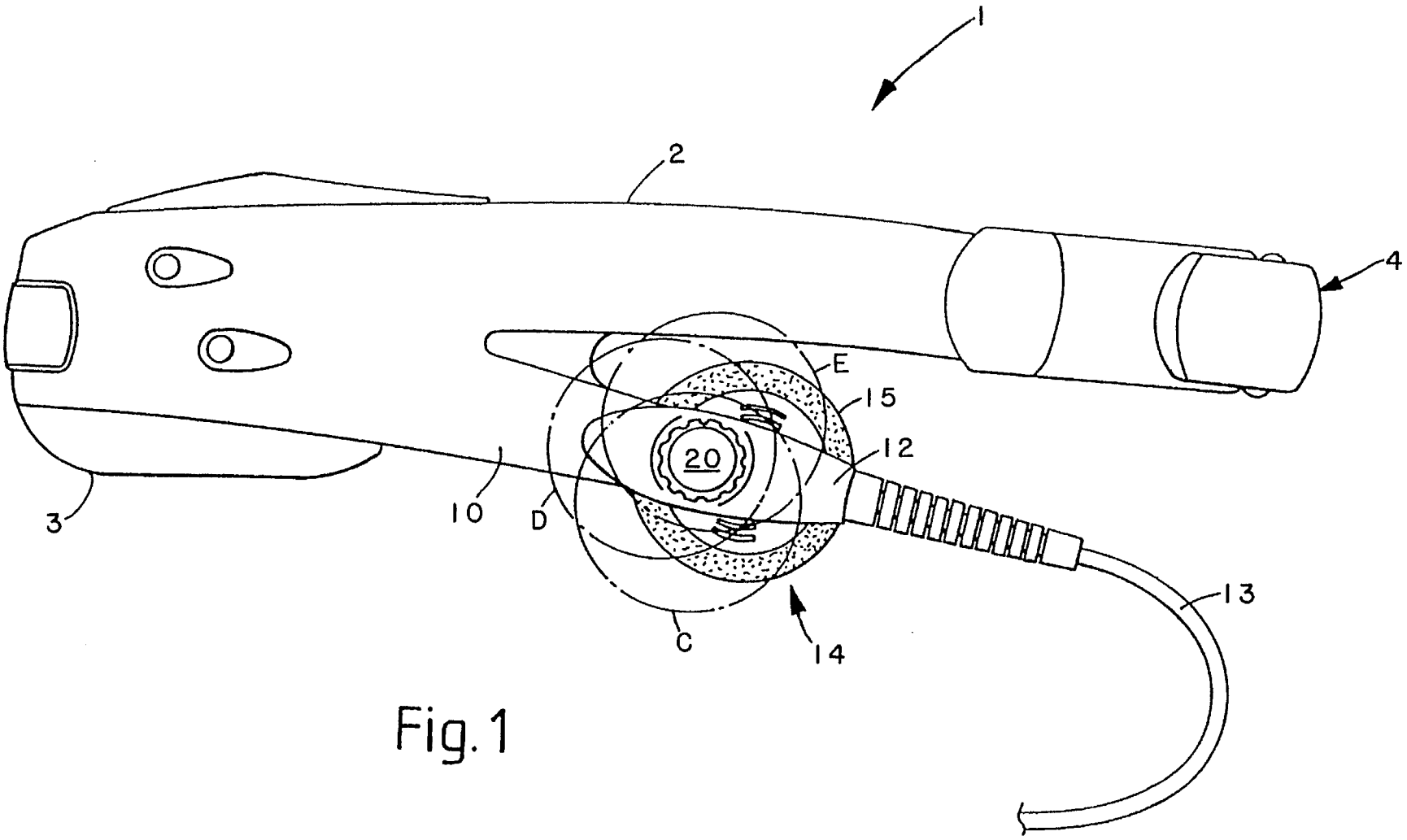
FIG. 1 is a side view of a head mounted display apparatus in accordance with the invention.

Returning once more to FIG. 1, it can be seen that extending rearwardly and downwardly of the main body of the annular band 2 at its left hand side is an elongate projection 10. A projection 11 similarly extends from the right hand side of the band 2. The following description details the construction associated with projection 10 and it will be appreciated that a complementary construction is associated with projection 11 which need not be described further.

Extending integrally and rearwardly of the projection 10 is a rigid end 12 of a cable harness 13. The harness 13 carries cabling for the optical display device 3 and for a left hand earphone means generally denoted 14.

Figure 3:
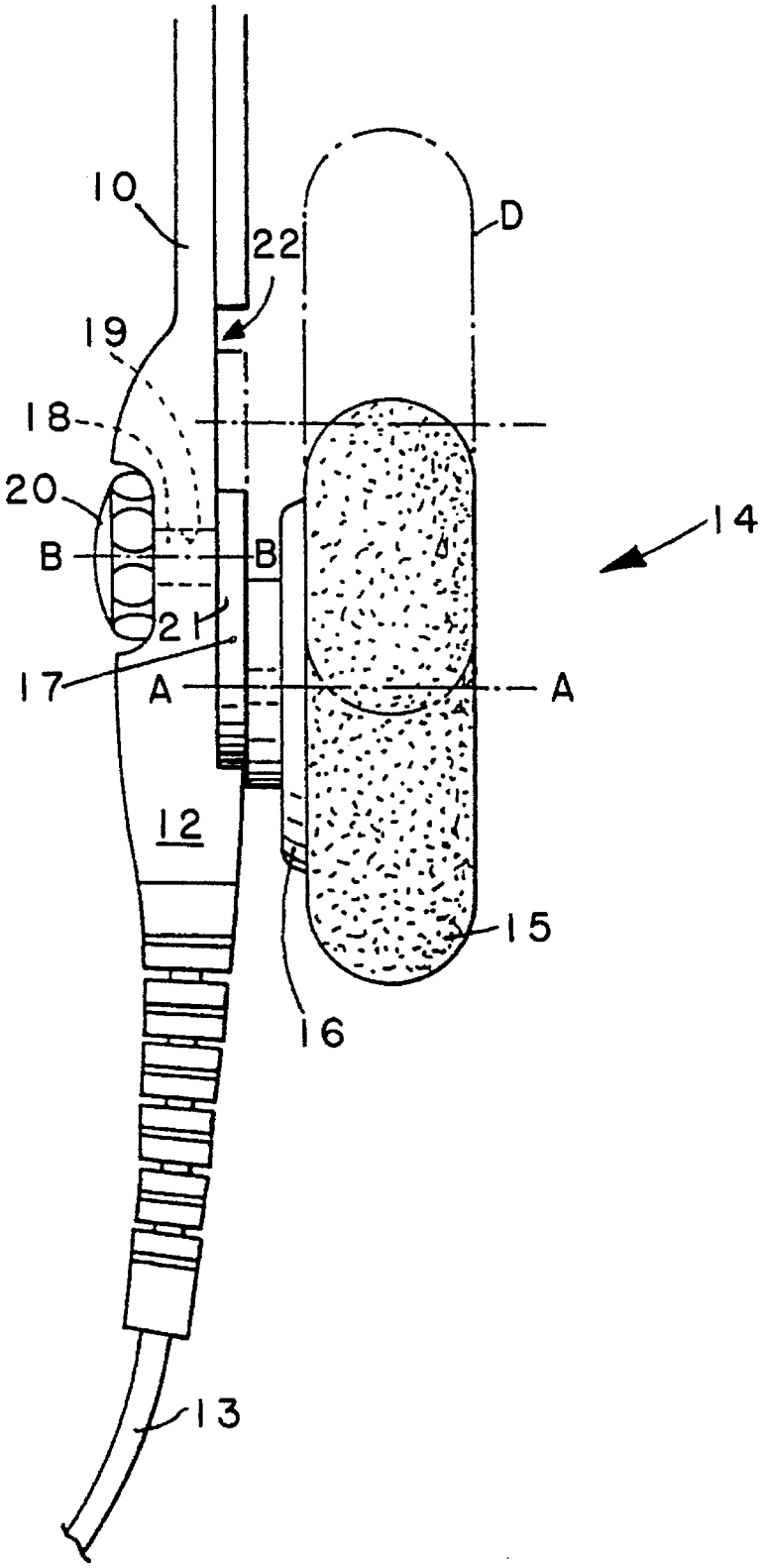
FIG. 3 is a plan view in the region of an earphone of the apparatus shown in FIG. 1.

Referring now to FIG. 3, the earphone means 14 comprises an earphone which is obscured by a doughnut shaped ear-pad 15 both of which are mounted to an inward face of a stepped cylindrical housing 16 concentrically along axis A—A. A mounting bracket 17 extends radially of an outward face of the housing 16. Adjacent the free end of bracket 17 a stud 18 extends outwardly therefrom along the axis B—B which is parallel to the axis A—A. This stud 18 is received so as to be rotatable in a throughbore 19 in the projection 10.

A screw-threaded blind bore (not shown) extends into the stud 18 from its free end which receives a threaded thumbscrew, the operating knob 20 of which is shown in the drawings. The bracket 17 is disposed so that its outer face 21 is able to seat within a recess 22 in the inner surface of the projection 10. This recess 22 is dimensioned so as to permit rotation of the bracket 17 fully about its axis B—B.

The earphone means 14 is eccentrically rotatable about axis A—A and may be locked in any given angular position by operation of knob 20 to clamp the bracket 17 against the base of the recess 22. The drawings show the earphone means 14 with the ear-pad 15 in its most rearward position. The chain dotted lines C, D and E show different angular positions of the ear-pad. It will be appreciated that while the axis B—B remains fixed relative to the optical display device 3 the earphone is rotatable about the axis A—A permitting the earphone means 14 to move relative to the member 2 to accommodate different ear positions. In this embodiment the earphone means or earphone mounting means 14 is able to be rotated through 360 degrees, i.e. through more than 180 degrees, about axis B—B.

In a second embodiment of the invention (not shown) it is desired that instead of being infininitely adjustable about axis B—B, the earphone means 14 should be movable between a predetermined number of angular positions only. For example it may be movable between the position shown in the drawings and positions C, D and E. To facilitate this the base of the recess 22 and the outward surface 21 of the bracket 17 may be formed with complementary interengaging detent formations (not shown).

In this embodiment the predetermined positions my be identified by suitable numeric markings so that frequent users of the apparatus will be able to select the numbered setting which best suit them.

I claim:

1. A head-mounted apparatus comprising a member adapted, when worn, to locate about a head of a wearer in a generally horizontal plane extending rearwardly from the bridge of the nose of the wearer and an earphone mounting means housing an earphone and being attached to one side of said member, said earphone mounting means being rotatable relative to said member about an axis eccentric of the earphone with said axis lying generally parallel to said plane, said axis extending transversely through said side of said member with the position of the earphone mounting means being adjustable relative to the member about said axis through more than 180 degrees to accommodate different ear positions.

2. Apparatus in accordance with claim 1, in which the member supports a forwardly disposed optical display device and is in the form of an annular head band adjustable to fit snuggly about the head of the wearer.

3. Apparatus in accordance with claim 2, in which the earphone mounting means has an inward annular face confronting, when worn, the head of the wearer and an outward face remote from the head of the wearer wherein the earphone is rigidly and concentrically housed in said mounting means and in which a foam ear-pad extends from said inward face with the outward face being eccentrically mounted to said member.

4. Apparatus in accordance with claim 3, in which the member further comprises at one side thereof a rearwardly and downwardly extending projection, a mounting bracket extends radially of the outward face of said mounting means and a pivot stud extends outwardly of and adjacent the free end of said bracket into a through-bore in said projection where it is rotatably received, with the arrangement providing that the axis of said stud is said axis eccentric of the earphone.

5. Apparatus in accordance with claim 4, in which the stud is a friction fit in said throughbore of the projection and is engaged at its free end by an operating knob on the opposite side of said projection to said bracket.

* * * * *